US006454902B1

(12) United States Patent
Chen

(10) Patent No.: US 6,454,902 B1
(45) Date of Patent: Sep. 24, 2002

(54) MANUFACTURE OF PAPER AND PAPERBOARD

(75) Inventor: Gordon Cheng I Chen, Chesapeake, VA (US)

(73) Assignee: Ciba Specialty Chemicals Water Treatments Ltd., Bradford (GB)

( * ) Notice: Subject to any disclaimer, the term of this patent is extended or adjusted under 35 U.S.C. 154(b) by 0 days.

(21) Appl. No.: 09/704,350

(22) Filed: Nov. 2, 2000

Related U.S. Application Data

(60) Provisional application No. 60/164,232, filed on Nov. 8, 1999.

(51) Int. Cl.[7] ..... D21H 17/42; D21H 17/68

(52) U.S. Cl. ..... 162/168.1; 162/168.3; 162/181.6; 162/181.8

(58) Field of Search ..... 162/127, 128, 162/164.1, 166, 168.1, 168.2, 168.3, 181.1, 181.6, 181.7, 181.8, 183, 175, 164.6, 168.4

(56) References Cited

U.S. PATENT DOCUMENTS

| | | | | | |
|---|---|---|---|---|---|
| 4,388,150 | A | | 6/1983 | Sunden et al. | 162/175 |
| 4,749,444 | A | | 6/1988 | Lorz et al. | 162/168.3 |
| 4,750,974 | A | * | 6/1988 | Johnson | 162/164.1 |
| 5,015,334 | A | * | 5/1991 | Derrick | 162/168.1 |
| 5,171,891 | A | | 12/1992 | Masilamani et al. | 562/411 |
| 5,234,548 | A | * | 8/1993 | Hatton | 162/168.3 |
| 5,393,381 | A | | 2/1995 | Hund et al. | 162/168.3 |
| 5,482,693 | A | | 1/1996 | Rushmere et al. | 423/328.1 |
| 5,676,796 | A | | 10/1997 | Cutts | 162/158 |
| 5,882,525 | A | | 3/1999 | Neff et al. | 210/735 |
| 5,958,188 | A | * | 9/1999 | Heard et al. | 162/168.2 |
| 6,103,064 | A | * | 8/2000 | Asplund et al. | 162/168.3 |
| 6,113,741 | A | * | 9/2000 | Kettunen et al. | 162/158 |
| 6,193,844 | B1 | * | 2/2001 | McLaughlin | 162/181.6 |

FOREIGN PATENT DOCUMENTS

| | | | |
|---|---|---|---|
| AU | 63977/86 | 10/1986 | D21H/3/02 |
| EP | 0 017 353 | 10/1980 | D21D/3/00 |
| EP | 0 102 760 | 3/1984 | C08F/2/32 |
| EP | 0 126 528 | 11/1984 | C08F/2/32 |
| EP | 0 150 933 | 8/1985 | C08F/6/00 |
| EP | 0 235 893 | 9/1987 | D21D/3/00 |
| EP | 0 308 752 | 3/1989 | D21D/3/00 |
| EP | 0 462 365 | 12/1991 | D21H/21/54 |
| EP | 0 484 617 | 5/1992 | C08F/2/32 |
| EP | 0 499 448 | 8/1992 | D21H/17/16 |
| EP | 0 608 986 | 8/1994 | D21H/23/76 |
| WO | 86/00100 | 1/1986 | D21H/3/20 |
| WO | 98/29604 | 7/1998 | D21H/23/14 |
| WO | 98/30753 | 7/1998 | D21H/23/76 |
| WO | 99/16708 | 4/1999 | C01B/35/10 |

* cited by examiner

*Primary Examiner*—Peter Chin
*Assistant Examiner*—Eric Hug
(74) *Attorney, Agent, or Firm*—David R. Crichton

(57) ABSTRACT

A process for making paper comprising forming a cellulosic suspension, flocculating the suspension, draining the suspension on a screen to form a sheet and then drying the sheet, wherein the cellulosic suspension is flocculated by addition of a water soluble polymer which is selected from a) a polysaccharide or b) a synthetic polymer of intrinsic viscosity at least 4 dl/g and then reflocculated by a subsequent addition of a reflocculating system, wherein the reflocculating system comprises i) a siliceous material and ii) a water soluble polymer. In one aspect the siliceous material is added prior to or simultaneous with the water soluble polymer. In an alternative for the water soluble polymer is anionic and added prior to the siliceous material.

18 Claims, No Drawings

MANUFACTURE OF PAPER AND PAPERBOARD

This application claims the benefit under 35 U.S.C. 119(e) of U.S. Provisional Application No. 60/164,232, filed Nov. 8, 1999.

This invention relates to processes of making paper and paperboard from a cellulosic stock, employing a novel flocculating system.

During the manufacture of paper and paper board a cellulosic thin stock is drained on a moving screen (often referred to as a machine wire) to form a sheet which is then dried. It is well known to apply water soluble polymers to the cellulosic suspension in order to effect flocculation of the cellulosic solids and enhance drainage on the moving screen.

In order to increase output of paper many modem paper making machines operate at higher speeds. As a consequence of increased machine speeds a great deal of emphasis has been placed on drainage and retention systems that provide increased drainage. However, it is known that increasing the molecular weight of a polymeric retention aid which is added immediately prior to drainage will tend to increase the rate of drainage but damage formation. It is difficult to obtain the optimum balance of retention, drainage, drying and formation by adding a single polymeric retention aid and it is therefore common practice to add two separate materials in sequence.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by Ciba Specialty Chemicals under the Hydrocolo trade mark has proved successful for more than a decade.

More recently there have been various attempts to provide variations on this theme by making minor modifications to one or more of the components.

U.S. Pat. No. 5393381 describes a process in which a process of making paper or board by adding a water soluble branched cationic polyacrylamide and a bentonite to the fibrous suspension of pulp. The branched cationic polyacrylamide is prepared by polymerising a mixture of acrylamide, cationic monomer, branching agent and chain transfer agent by solution polymerisation.

U.S. Pat. No. 5882525 describes a process in which a cationic branched water soluble polymer with a solubility quotient greater than about 30% is applied to a dispersion of suspended solids, e.g. a paper making stock, in order to release water. The cationic branched water soluble polymer is prepared from similar ingredients to U.S. Pat. No. 5393381 i.e. by polymerising a mixture of acrylamide, cationic monomer, branching agent and chain transfer agent.

In EP-A-17353 a relatively crude pulp, having high cationic demand, is treated with bentonite followed by substantially non-ionic polymeric retention aid. Although the suspension in this process is a substantially unfilled suspension, in AU-A-63977/86 a modification is described in which the suspension can be filled and in which bentonite is added to thickstock, the thickstock is then diluted to form thinstock, a relatively low molecular weight cationic polyelectrolyte is added to the thinstock, and a high molecular weight non-ionic retention aid is then added. Thus in this process coagulant polymer is used, and it is added to the thinstock after the bentonite.

Processes such as those in EP 17353 and AU 63977186 are satisfactory as regards the manufacture of paper from a suspension that has relatively high cationic demand and relatively low filler content, but tend to be rather unsatisfactory as regards filler retention when the suspension contains significant amounts of filler.

EP-A-608986 describes a process for making filled paper by adding a cationic coagulant to the feed suspension to flocculate a relatively concentrated suspension of fibre and filler adding bentonite or other anionic particulate material to the cellulosic thinstock or thickstock and subsequently adding polymeric retention aid to the thinstock before draining the thinstock to form a sheet. Fibre and filler retention are said to be improved by the presence of the coagulant in the concentrated suspension of the fibre and filler.

EP-A-308752 describes a method of making paper in which a low molecular weight cationic organic polymer is added to the furnish and then a colloidal silica and a high molecular weight charged acrylamide copolymer of molecular weight at least 500,000. The disclosure appears to indicate that the broadest range of molecular weights afforded to the low molecular weight cationic polymer added first to the furnish is 1,000 to 500,000. Such low molecular weight polymers would be expected to exhibit intrinsic viscosities up to about 2dl/g.

TM Gallager 1990 TAPPI Press, Atlanta p141 Short Course entitled Neutral/Alkaline Paper making describes an allegedly commercial available silica microparticle system using a cationic coagulant polymer, a high molecular weight anionic polyacrylamide and a 5-nm colloidal silica sol. Such coagulant polymers would have low molecular weights and high charge density. It is stated that although there is a potential for high retention, formation is still an issue with high doses of anionic polyacrylamide. A lower addition of silica (less than 0.10%) is commonly used in this system.

However, there still exists a need to further enhance paper making processes by further improving drainage and retention without impairing formation. Furthermore there also exists the need for providing a more effective flocculation system for making highly filled paper.

According to a first aspect of the present invention a process is provided for making paper or paper board comprising forming a cellulosic suspension, flocculating the suspension, draining the suspension on a screen to form a sheet and then drying the sheet, wherein the cellulosic suspension is flocculated by addition of a substantially water soluble polymer selected from, a) a polysaccharide or b) a synthetic polymer of intrinsic viscosity at least 4 dl/g and then reflocculated by a subsequent addition of a reflocculating system, wherein the reflocculating system comprises i) a siliceous material and ii) a substantially water soluble polymer, characterised in that either, the siliceous material and water soluble polymer are added to the suspension simultaneously or the siliceous material before the addition of the water soluble polymer.

According to a second aspect of the present invention a process is provided for making paper or paper board comprising forming a cellulosic suspension, flocculating the suspension, draining the suspension on a screen to form a sheet and then drying the sheet, wherein the cellulosic suspension is flocculated by addition of a substantially water soluble polymer selected from, a) a polysaccharide or b) a synthetic polymer of intrinsic viscosity at least 4 dl/g and then reflocculated by a subsequent addition of a reflocculating system, wherein the reflocculating system comprises i) a siliceous material and ii) a substantially water soluble anionic polymer, characterised in that the water soluble anionic- polymer is added to the cellulosic suspension before the addition of the siliceous material.

It has surprisingly been found that flocculating the cellulosic suspension using a flocculation system that comprises applying to the cellulosic suspension a multicomponent system comprising a water soluble polymer of intrinsic viscosity above 4 dl/g which is followed by the reflocculation system of the invention provides improvements in retention and drainage without any significant impairment of formation in comparison to other known processes.

The siliceous material may be any of the materials selected from the group consisting of silica based particles, silica microgels, colloidal silica, silica sols, silica gels, polysilicates, cationic silica, aluminosilicates, polyaluminosilicates, borosilicates, polyborosilicates, zeolites and swelling clays. This siliceous material may be in the form of an anionic microparticulate material. When the siliceous material is a swelling clay it may typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. The flocculating material may be bentonite as defined by EP-A-235895 or EP-A-335575.

Thus the first component of the flocculating system according to the invention is the water soluble polymer which is added to the cellulosic suspension prior to the reflocculating system. The water soluble polymer should be of sufficient molecular weight as to bring about bridging flocculation throughout the cellulosic suspension. The water soluble polymer may be any suitable natural or synthetic polymer. It may be a natural polymer such as a polysaccharide such as a starch, for instance anionic, nonionic, amphoteric, preferably cationic starch. The natural polymer may be of any molecular weight but preferably will be of high molecular weight and may for instance exhibit an intrinsic viscosity of above 4 dl/g. Preferably the polymer is a high molecular weight synthetic water soluble polymer. Thus the polymer may be any water soluble polymer of intrinsic viscosity of at least 4 dl/g. Preferably such polymers have an intrinsic viscosity of at least 7dl/g, for instance as high as 16 or 18 dl/g, but usually in the range 7 or 8 to 14 or 15 dl/g. The water soluble polymer may be anionic, nonionic, amphoteric but is preferably cationic. The water soluble polymer may be derived from any water soluble monomer or monomer blend. By water soluble we mean that the monomer has a solubility in water of at least 5 g/100cc.

The water soluble polymeric first component of the flocculating system desirably may be a nonionic polymer or alternatively an ionic polymer. When the polymer is ionic it is preferred that the ionic content is low to medium. For instance the charge density of the ionic polymer may be below 5 meq/g, preferably below 4 especially below 3 meq/g. Typically the ionic polymer may comprise up to 50% by weight ionic monomer units. When the polymer is ionic it may be anionic, cationic or amphoteric. When the polymer is anionic it may be derived from a water soluble monomer or monomer blend of which at least one monomer is anionic or potentially anionic. The anionic monomer may be polymerised alone or copolymerised with any other suitable monomer, for instance any water soluble nonionic monomer. Typically the anionic monomer may be any ethylenically unsaturated carboxylic acid or sulphonic acid. Preferred anionic polymers are derived from acrylic acid or 2-acrylamido-2-methylpropane sulphonic acid. When the water soluble polymer is anionic it is preferably a copolymer of acrylic acid (or salts thereof with acrylamide. When the polymer is nonionic it may be any poly alkylene oxide or a vinyl addition polymer which is derived from any water soluble nonionic monomer or blend of monomers. Typically the water soluble nonionic polymer is polyethylene oxide or acrylamide homopolymer.

When the first component of the flocculating system is nonionic or anionic it may be desirable to pre-treat the cellulosic suspension with a cationic treatment agent, for instance alum, polyaluminium chloride, aluminium chloro hydrate or alternatively a cationic substantially water soluble polymer. Such cationic pre-treatement may be directly to the cellulosic suspension or the any of the components of the cellulosic suspension.

The first component of the flocculating system is preferably cationic or potentially cationic water soluble polymer. The preferred cationic water soluble polymers have cationic or potentially cationic functionality. For instance the cationic polymer may comprise free amine groups which become cationic once introduced into a cellulosic suspension with a sufficiently low pH as to protonate free amine groups. Preferably however, the cationic polymers carry a permanent cationic charge, such as quaternary ammonium groups. Desirably the polymer may be formed from a water soluble ethylenically unsaturated cationic monomer or blend of monomers wherein at least one of the monomers in the blend is cationic. The cationic monomer is preferably selected from di allyl di alkyl ammonium chlorides, acid addition salts or quaternary ammonium salts of either dialkyl amino alkyl (meth) acrylate or dialkyl amino alkyl (meth) acrylamides. The cationic monomer may be polymerised alone or copolymerised with water soluble non-ionic, cationic or anionic monomers. Particularly preferred cationic polymers include copolymers of methyl chloride quaternary ammonium salts of dimethylaminoethyl acrylate or methacrylate.

The first component may be an amphoteric polymer and thus would comprise both anionic or potentially anionic and cationic or potentially cationic functionality. Thus the amphoteric polymer may be formed from a mixture of monomers of which at least one is cationic or potentially cationic and at least one monomer is anionic or potentially anionic and optionally at least one nonionic monomer is present. Suitable monomers would include any of the cationic, anionic and nonionic monomers given herein. A preferred amphoteric polymer would be a polymer of acrylic acid with methyl chloride quaternised dimethyl amino ethyl acrylate and acrylamide.

Desirably the first component may be a water soluble polymer with a rheological oscillation value of tan delta at 0.005 Hz of above 1.1 (defined by the method given herein) for instance as provided for in copending-patent application based on the priority U.S. patent application Ser. No. 60/164,231 (reference PP/W-21916/ P1/AC 526) filed with equal date to the priority of the present application. The water soluble polymer may also have a slightly branched structure for instance by incorporating small amounts of branching agent e.g. up to 20 ppm by weight. Typically the branching agent includes any of the branching agents defined herein suitable for preparing the branched anionic polymer. Such branched polymers may also be prepared by including a chain transfer agent into the monomer mix. The chain transfer agent may be included in an amount of at least 2 ppm by weight and may be included in an amount of up to 200 ppm by weight. Typically the amounts of chain transfer agent are in the range 10 to 50 ppm by weight. The chain transfer agent may be any suitable chemical substance, for instance sodium hypophosphite, 2-mercaptoethanol, malic acid or thioglycolic acid.

Branched polymers comprising chain transfer agent may be prepared using higher levels of branching agent, for instance up to 100 or 200 ppm by weight, provided that the amounts of chain transfer agent used are sufficient to ensure that the polymer produced is water soluble. Typically the branched water soluble polymer may be formed from a water soluble monomer blend comprising at least one cationic monomer, at least 10 molar ppm of a chain transfer agent and below 20 molar ppm of a branching agent. Preferably the branched water soluble polymer has a rheological oscillation value of tan delta at 0.005 Hz of above 0.7 (defined by the method given herein).

The water soluble polymers may also be prepared by any convenient process, for instance by solution polymerisation, water-in-oil suspension polymerisation or by water-in-oil emulsion polymerisation. Solution polymerisation results in aqueous polymer gels which can be cut dried and ground to provide a powdered product. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

According to the invention the water soluble polymers added to the cellulosic suspension prior to the reflocculating system may be added at any suitable point. The polymer may be added very early in the process, for instance into the thick stock, but is preferably added to the thin stock. The polymer may be added in any effective amount to achieve flocculation. Usually the dose of the polymer would be above 20 ppm by weight of cationic polymer based on dry weight of suspension. Preferably it is added in an amount of at least 50 ppm by weight for instance 100 to 2000 ppm by weight. Typically the polymer dose may above 150 ppm and may be at more than 200 ppm and can be greater than 300 ppm. Often the dose may be in the range 150 to 600 ppm, especially between 200 and 400 ppm.

The siliceous material and water soluble polymer components of the reflocculating system may be added substantially simultaneously to the cellulosic suspension. For instance the two components may be added to the cellulosic suspension separately but at the same stage or dosing point. When the components of the reflocculating system are added simultaneously the siliceous material and the water soluble polymer may be added as a blend. The mixture may be formed in-situ by combining the siliceous material and the water soluble polymer at the dosing point or in the feed line to the dosing point. It is preferred that the reflocculating system comprises a pre formed blend of the siliceous material and water soluble polymer.

In an alternative preferred form of the invention the two components of the reflocculating system are added sequentially wherein the siliceous material is added prior to the addition of the water soluble polymer of the reflocculating system.

The siliceous material may be any of the materials selected from the group consisting of silica based particles, silica microgels, colloidal silica, silica sols, silica gels, polysilicates, aluminosilicates, polyaluminosilicates, borosilicates, polyborosilicates and zeolites. This siliceous material may be in the form of an anionic microparticulate material. Alternatively the siliceous material may be a cationic silica.

In one more preferred form of the invention the siliceous material is selected from silicas and polysilicates. The silica may be any colloidal silica, for instance as described in WO-A-8600100. The polysilicate may be a colloidal silicic acid as described in U.S. Pat. No. 4,388,150.

The polysilicates of the invention may be prepared by acidifying an aqueous solution of an alkali metal silicate. For instance polysilicic microgels otherwise known as active silica may be prepared by partial acidification of alkali metal silicate to about pH 8–9 by use of mineral acids or acid exchange resins, acid salts and acid gases. It may be desired to age the freshly formed polysilicic acid in order to allow sufficient three dimensional network structure to form. Generally the time of ageing is insufficient for the polysilicic acid to gel. Particularly preferred siliceous materials include polyalumino-silicates. The polyaluminosilicates may be for instance aluminated polysilicic acid, made by first forming polysilicic acid microparticles and then post treating with aluminium salts, for instance as described in U.S. Pat. No. 5,176,891. Such polyaluminosilicates consist of silicic microparticles with the aluminium located preferentially at the surface.

Alternatively the polyaluminosilicates may be polyparticulate microgels of surface area in excess of 1000 $m^2/g$ formed by reacting an alkali metal silicate with acid and water soluble aluminium salts, for instance as described in U.S. Pat. No. 5,482,693. Typically the polyaluminosilicates may have a mole ratio of alumina:silica of between 1:10 and 1:1500.

Polyaluminosilicates may be formed by acidifying an aqueous solution of alkali metal silicate to pH 9 or 10 using concentrated sulphuric acid containing 1.5 to 2.0% by weight of a water soluble aluminium salt, for instance aluminium sulphate. The aqueous solution may be aged sufficiently for the three dimensional microgel to form. Typically the polyaluminosilicate is aged for up to about two and a half hours before diluting the aqueous polysilicate to 0.5 weight % of silica.

The siliceous material may be a colloidal borosilicate, for instance as described in WO-A-9916708. The colloidal borosilicate may be prepared by contacting a dilute aqueous solution of an alkali metal silicate with a cation exchange resin to produce a silicic acid and then forming a heel by mixing together a dilute aqueous solution of an alkali metal borate with an alkali metal hydroxide to form an aqueous solution containing 0.01 to 30 % $B_2O_3$, having a pH of from 7 to 10.5. In one preferred aspect the siliceous material is a silica Preferably when the siliceous material is a silica or silicate type material it has a particle size in excess of 10 nm. More preferably the silica or silicate material has a particle size in the range 20 to 250 nm, especially in the range 40 to 100 nm.

In a more preferred form of the invention the siliceous material is a swelling clay. The swellable clays may for instance be typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. Typical anionic swelling clays are described in EP-A-235893 and EP-A-335575.

Most preferably the clay is a bentonite type clay. The bentonite may be provided as an alkali metal bentonite. Bentonites occur naturally either as alkaline bentonites, such as sodium bentonite or as the alkaline earth metal salt, usually the calcium or magnesium salt. Generally the alkaline earth metal bentonites are activated by treatment with sodium carbonate or sodium bicarbonate. Activated swellable bentonite clay is often supplied to the paper mill as dry powder. Alternatively the bentonite may be provided as a high solids flowable slurry of activated bentonite, for example at least 15 or 20% solids, for instance as described in EP-A-485124, WO-A-9733040 and WO-A-9733041.

In paper making the bentonite may be applied to the cellulosic suspension as an aqueous bentonite slurry. Typically the bentonite slurry comprises up to 10% by weight bentonite. The bentonite slurry will normally comprise at least 3% bentonite clay, typically around 5% by weight bentonite. When supplied to the paper mill as a high solids flowable slurry usually the slurry is diluted to an appropriate concentration. In some instances the high solids flowable slurry of bentonite may be applied directly to the paper making stock.

Desirably the siliceous material is applied in an amount of at least of at least 100 ppm by weight based on dry weight of suspension. Desirably the dose of siliceous material may be as much as 10,000 ppm by weight or higher. In one preferred aspect of the invention doses of 100 to 500 ppm by weight have been found to be effective. Alternatively-higher doses of siliceous material may be preferred, for instance 1000 to 2000 ppm by weight.

The water soluble polymer of the reflocculating system may desirably be formed from a water soluble monomer or blend of water soluble monomers. By water soluble we mean that the monomer has a solubility in water of at least 5 g/100cc. Alternatively the polymer of the reflocculating system is a natural polymer, for instance a polysaccharide. Desirably the polysaccharide is a starch. The polymers may be nonionic, cationic, amphoteric but are preferably anionic. The polymers of the reflocculating system may be the same or different to the polymers of the flocculating system.

The water soluble polymer of the reflocculating system may be of any molecular weight, but generally exhibits an intrinsic viscosity of least 1.5 dl/g Desirably the water soluble polymeric reflocculating agent is of relatively high molecular weight and has an intrinsic viscosity of at least 3 or 4 dl/g and often will have an intrinsic viscosity of at least 7 dl/g or 10 dl/g. The polymeric reflocculating agent may have an intrinsic viscosity as high as 25 or 30 dl/g but usually does not have an intrinsic viscosity above 20 dl/g. Preferably the polymeric reflocculating agent will have an intrinsic viscosity of between 7 dl/g and 16 or 17 d/lg especially 8 to 11 or-12 dl/g. The polymer may be branched, for instance by inclusion of branching agents as discussed earlier in the specification with regard to the first polymeric component of the flocculating system. Preferably, however, the flocculating system is substantially linear, that is the polymer is prepared substantially in the absence of branching agent.

In one aspect of the invention the water soluble polymeric reflocculating agent is an anionic polymer. The anionic polymer may bear potentially ionisable groups which become ionised on application to the cellulosic suspension. However, preferably the polymer is formed from at least one water soluble anionic monomer. Preferably the anionic polymer is formed from a water soluble monomer or blend of water soluble monomers. The blend of water soluble monomers may comprise one or more water soluble anionic monomers optionally with one or more water soluble nonionic monomers. The anionic monomers may include ethylenically unsaturated carboxylic acids (including salts thereof) and ethylenically unsaturated sulphonic acids monomers (including salts thereof).

Typically the anionic monomers may be selected from acrylic acid, methacrylic acid, 2-acrylamido-2-methylpropane-sulphonic acid or alkali metal salts thereof. The nonionic monomers optionally blended with the anionic monomers include any water soluble nonionic monomers that are compatible with the anionic monomers. For instance suitable nonionic monomers include acrylamide, methacrylamide, 2-hydroxyethyl acrylate and N-vinylpyrrolidone. Particularly preferred anionic polymers include copolymers of acrylic acid or sodium acrylate with acrylamide. The anionic polymer may comprise 100% anionic monomer or relatively small amounts of anionic monomer, for instance 1% by weight or less. Generally, however, suitable anionic polymers tend to comprise at least 5% anionic monomer units and usually at least 10% by weight anionic monomer units. Often the anionic polymer may comprise up to 90 or 95% by weight anionic monomer units. Preferred anionic polymers comprise between 20 and 80% by weight anionic monomer and more preferably 40 to 60% by weight anionic monomer units.

In an alternative form of the invention the water soluble polymeric reflocculating agent is a cationic polymer. The cationic polymer may bear potentially ionisable groups which become ionised on application to the cellulosic suspension, for instance monomers carrying pendant free amine groups. However, preferably the polymer is formed from at least one water soluble cationic monomer. Preferably the cationic polymer is formed from a water soluble monomer or blend of water soluble monomers. The blend of water soluble monomers may comprise one or more water soluble cationic monomers optionally with one or more water soluble nonionic monomers. The cationic monomers include quaternary ammonium salts of amino alkyl (meth)acrylates or amino alkyl (meth) acrylamides and diallyl dimethyl ammonium chloride etc. Where the cationic polymers are formed from a blend of cationic monomer with non-ionic monomers, suitable nonionic monomers may be any water soluble nonionic monomers which are compatible with the cationic monomers, for example the non-ionic monomers referred to above with regard to the anionic polymers.

Particularly preferred polymers include copolymers of methyl chloride quaternised dimethyl amino ethyl acrylate with acrylamide. The cationic polymer may comprise only cationic monomer units or alternatively may only comprise relatively small amounts of cationic monomer, for instance 1% by weight or less. Generally the cationic polymer comprises at least 5% cationic monomer units and usually at least 10% by weight cationic monomer units. Often the cationic polymer may comprise up to 90 or 95% by weight cationic monomer units. Preferred cationic polymers comprise between 20 and 80% by weight cationic monomer and more preferably 40 to 60% by weight cationic monomer units.

In yet another form of the invention the water soluble polymeric reflocculating agent is an amphoteric polymer. The amphoteric polymer may bear potentially ionisable groups which become ionised on application to the cellulosic suspension, for instance monomers carrying pendant free amine groups and/or ionisable -acid groups. However, preferably the polymer is formed from-at least one water soluble cationic monomer and at least one anionic monomer. Preferably the amphoteric polymer is formed from a water soluble monomer or blend of water soluble monomers. The blend of water soluble monomers may comprise one or more water soluble cationic monomers and one or more water soluble anionic monomers, optionally with one or more water soluble nonionic monomers.

The cationic monomers include quaternary ammonium salts of amino alkyl (meth)acrylates or amino alkyl (meth) acrylamides and diallyl dimethyl ammonium chloride etc. The anionic monomers may include ethylenically unsaturated carboxylic acids (including salts thereof) and ethylenically unsaturated sulphonic acids monomers (including salts thereof. Typically the anionic monomers may be selected from acrylic acid, methacrylic acid, 2-acrylamido-2-methylpropane-sulphonic acid or alkali metal salts thereof. Where the amphoteric polymers are formed from a blend of cationic monomer, anionic monomer and non-ionic monomer, suitable nonionic monomers may be any water soluble nonionic monomers which are compatible with the anionic and cationic monomers, for example the non-ionic monomers referred to above with regard to the anionic polymers. A particularly preferred polymer is the copolymer of methyl chloride quaternised dimethylamino ethyl acrylate, acrylic acid and acrylamide.

The amphoteric polymer may comprise relatively small amounts of anionic and cationic monomer units, for instance 1% by weight or less of each. However, generally the amphoteric polymer will comprise at least 5% anionic monomer units and at least 5% by weight cationic monomer units, In some cases it may be desirable to have more of one ionic monomer than the other. For instance it may be desirable to have a greater amount of cationic monomer than anionic monomer. Usually the amphoteric polymer comprises at least 10% by weight cationic monomer units and often greater than 20 or 30% cationic units. Preferably the amphoteric polymer comprises between 20 and 80% by weight cationic monomer units and more preferably 40 to 60% by weight cationic monomer units. The amphoteric polymer may comprise-at least 20 or 30% anionic monomer units. It may be desirable for the amphoteric polymer to comprise at least 40 or 50% by weight anionic units. The water soluble amphoteric polymer may be linear or alternatively is branched for instance by including small amounts of branching agent in the monomer as described previously in this specification.

In a still further form of the invention the water soluble polymeric reflocculating agent is a nonionic polymer. The nonionic polymer may be any water soluble polymer of intrinsic viscosity at least 1.5 dl/g which exhibits essentially no ionic character. The nonionic polymer may be a polyalkylene oxide for instance polyethylene oxide or polypropylene oxide or may be a vinyl addition polymer formed from ethylenically unsaturated nonionic monomers or a blend of ethylenically unsaturated nonionic monomers. Suitable monomers include acrylamide, methacrylamide, 2-hydroxyethyl acrylate and N-vinylpyrrolidone. Preferred nonionic polymers include polyethylene oxide and the homopolymer of acrylamide. The water soluble nonionic polymer may be linear or alternatively is branched for instance by including small amounts of branching agent in the monomer as described previously in this specification.

The water soluble polymeric reflocculating agents may also be prepared by any convenient process, for instance by solution polymerisation, water-in-oil suspension polymerisation or by water-in-oil emulsion polymerisation. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

The water soluble polymeric component of the reflocculating system is added in an amount sufficient to achieve flocculation. Typically the dose of reflocculating polymer would be above 20 ppm by weight of polymer based on dry weight of suspension although it may be as high as 2000 ppm. Preferably, however, the polymeric reflocculating agent is applied in an amount of at least 50 ppm by weight for instance 150 ppm to 600 ppm by weight, especially between 200 and 400 ppm.

In one preferred aspect of the invention the flocculated cellulosic suspension is subjected to mechanical shearing prior to the addition of the siliceous material. Thus the flocculated suspension may be passed through one or more shear stages selected from pumping, mixing or cleaning stages prior to adding the siliceous material. Thus where the thin stock suspension is first flocculated by addition of the cationic polymer the suspension may be passed through at least one fan pump and/or a centri-screen before being reflocculated by the siliceous material. The shearing tends to mechanically degrade the flocculated material in the thin stock suspension, thus producing smaller flocs. The mechanically degraded flocs also tend to have newly formed surfaces onto which the siliceous material can readily associate, thus enhancing and improving the reflocculation.

In another preferred aspect of the invention the reflocculated suspension, formed by addition of the siliceous material, is subjected to mechanical shearing prior to the addition of the water soluble polymeric reflocculating agent. Thus the reflocculated suspension may be passed through one or more shear stages as defined above. The mechanically degraded flocs of the reflocculated thin stock suspension tend be smaller and due to the formation of new surfaces further flocculation by the water soluble polymeric reflocculating agent may be achieved more effectively. Thus in one particularly preferred form the thin stock suspension is flocculated by use of a cationic water soluble polymer of intrinsic viscosity above 4 dl/g and the flocculated suspension is passed through one or more shear stages as given herein, and then the sheared reflocculated suspension is then treated with the siliceous material followed by a further shearing mechanical step and then the sheared reflocculated thin stock suspension is further flocculated by addition of the water soluble polymeric reflocculating agent of intrinsic viscosity at least 1.5 dl/g.

The water soluble polymeric reflocculating agent is generally the last treatment agent in the process and thus tends to be added later in the system and often closer to the drainage stage. Thus the polymeric reflocculating agent-tends to be added after the last point of high shear, which may be for instance the centri-screen. Therefore for a particularly preferred process the water soluble polymeric reflocculating agent is added subsequent to the centri-screen.

In an alternative preferred aspect of the invention there is no mechanical shearing between the addition of the siliceous material to bring about reflocculation and the addition of the water soluble polymeric reflocculating agent. Although it may be desirable to mechanically shear the flocculated suspension following the addition of the water soluble polymeric reflocculation agent, in this form of the invention it is preferred that there is no substantial shearing following the addition of the polymeric reflocculation agent. Thus in this preferred aspect of the invention both the siliceous material and the water soluble polymeric reflocculating agent are added subsequent to the centri-screen.

In all preferred forms of the invention the water soluble polymeric reflocculation agent tends to be added late in the process, for instance between the centri-screen and draining. Since it is generally an accepted view that increasing the floc structure tends to reduce formation, it is surprising that the process of the invention where the last polymeric reflocculation lation aid is added close to the draining stage and yet brings about no significant reduction to formation and yet significantly improves the drainage and retention properties over other processes described in the prior art.

In the invention it may be desirable to further include additional flocculating or coagulating materials. For instance the flocculating system may additionally comprise water soluble organic polymers, or inorganic materials such as alum, polyaluminium chloride, aluminium chloride trihydrate and aluminochloro hydrate. The water soluble organic polymers may be natural polymers, such as cationic starch, anionic starch and amphoteric starch. Alternatively the water soluble polymer may be a synthetic polymer which could be amphoteric, anionic, nonionic or more preferably cationic. The water soluble polymer may be any water soluble polymer-preferably exhibiting ionic character. The preferred ionic water soluble polymers have cationic or potentially cationic functionality.

It may be desirable to additionally incorporate a cationic coagulant into the cellulosic thick stock or the components of the thick stock. Such a cationic water soluble polymer may be a relatively low molecular weight polymer of relatively high cationicity. For instance the polymer may be a homopolymer of any suitable ethylenically unsaturated cationic monomer polymerised to provide a polymer with an intrinsic viscosity of up to 3 dl/g. Homopolymers of diallyl dimethyl ammonium chloride are preferred. The low molecular weight high cationicity polymer may be an addition polymer formed by condensation of amines with other suitable di- or tri- functional species. For instance the polymer may be formed by reacting one or more amines selected from dimethyl amine, trimethyl amine and ethylene diamine etc and epihalohydrin,-epichlorohydrin being preferred. The purpose of such an additional ingredient may be use for charge neutralisation for example in cases where the pulp has a relatively high cationic demand, such as for instance when making newsprint. Alternatively the cationic coagulant may serve to fix pitch and/or stickies.

Although it is possible to include these additional materials such as organic cationic coagulants, alum or other inorganic species, it is not normally necessary and the preferred process would be conducted in the absence of cationic coagulants.

In one preferred form of the invention the cellulosic suspension is subjected to mechanical shear following addition of at least one of the components of the flocculating system. Thus in this preferred form at least one component of the flocculating system is mixed into the cellulosic suspension causing flocculation and the flocculated suspension is then mechanically sheared. This shearing step may be achieved by passing the flocculated suspension through one or more shear stages, selected from pumping, cleaning or mixing stages. For instance such shearing stages include fan pumps and centri-screens, but could be any other stage in the process where shearing of the suspension occurs.

The mechanical shearing step desirably acts upon the flocculated suspension in such a way as to degrade the flocs. All of the components of the flocculating system may be added prior to a shear stage although preferably at least the last component of the flocculating system is added to the cellulosic suspension at a point in the process where there is no substantial shearing before draining to form the sheet. Thus it is preferred that at least one component of the flocculating system is added to the cellulosic suspension and the flocculated suspension is then subjected to mechanical shear wherein the flocs are mechanically degraded and then at least one component of the flocculating system is added to reflocculate the suspension prior to draining.

In one preferred form of the invention we provide a process of preparing paper from a cellulosic stock suspension comprising filler. The filler may be any traditionally used filler materials. For instance the filler may be clay such as kaolin, or the filler may be a calcium carbonate which could be ground calcium carbonate or in particular precipitated calcium carbonate, or it may be preferred to use titanium dioxide as the filler material. Examples of other filler materials also include synthetic polymeric fillers.

Generally a cellulosic stock comprising substantial quantities of filler are more difficult to flocculate. This is particularly true of fillers of very fine particle size, such as precipitated calcium carbonate. Thus according to a preferred aspect of the present invention we provide a process for making filled paper. The paper making stock may comprise any suitable amount of filler. Generally the cellulosic suspension comprises at least 5% by weight filler material. Typically the cellulosic suspension comprises up to 40% filler, preferably between 10% and 40% filler. Desirably the final sheet of paper or paper board comprises up to 40% by weight filler. Thus according to this preferred aspect of this invention we provide a process for making filled paper or paper board wherein we first provide a cellulosic suspension comprising filler and in which the suspension solids are flocculated by introducing into the suspension a flocculating system comprising a water soluble polymer of intrinsic viscosity at least 4 dl/g a siliceous material and then a water-soluble polymer of intrinsic viscosity at least 1.5 dl/g as defined herein. In an alternative form of the invention form we provide a process of preparing paper or paperboard from a cellulosic stock suspension which is substantially free of filler.

The following examples illustrate the invention.

EXAMPLE 1

Comparative

The drainage properties are determined using Schopper-Riegler apparatus, with the rear exit blocked so the drainage water exits through the front opening. The cellulosic stock used is a 50/50 hardwood/softwood suspension and 40% by weight (on total solids) precipitated calcium carbonate. The stock suspension is beaten to a freeness of 55° (Schopper Riegler method) before the addition of filler. 5 kg per tonne (on total solids) cationic starch (0.045 DS) is added to the suspension.

A copolymer of acrylamide with methyl chloride quaternary ammonium salt of dimethylaminoethyl acrylate (75/25 wt./wt.) of intrinsic viscosity above 11.0 dl/g (Product A) is mixed with the stock and then after shearing the stock using a mechanical stirrer bentonite was added. The drainage times for each dose of Product A and bentonite are shown in seconds in Table 1.

TABLE 1

| | | Bentonite (g/t) | | |
|---|---|---|---|---|
| | | 0 | 500 | 1000 |
| Product A (g/t) | 0 | 102 | — | — |
| | 500 | — | 34 | 27 |
| | 1000 | — | — | 14 |

EXAMPLE 2

The drainage tests of Example 1 is repeated for a dose of 500 g/t product A and 500 g/t bentonite except that following the addition of bentonite a further shear stage was applied followed by (Product B) a linear water soluble anionic copolymer of acrylamide with sodium acrylate (62.9/37.1) (wt./wt.) of intrinsic viscosity 16 dl/g. The drainage times are shown in Table 2.

TABLE 2

| Product B dosage (g/t) | drainage time (s) |
|---|---|
| 0 | 34 |
| 125 | 17 |
| 250 | 13 |
| 500 | 10 |

As can be seen even a dose of 125 g/t Product B substantially improves drainage.

EXAMPLE 3

Example 2 is repeated except that the bentonite and Product B (anionic polymer) is applied simultaneously to provide analogous results.

EXAMPLE 4

Example 2 is repeated except that product B (anionic polymer) is applied before the bentonite. The results are better than the process without Product B.

What is claimed is:

1. A process for making paper or paper board comprising forming a cellulosic suspension, flocculating the suspension, draining the suspension on a screen to form a sheet and then drying the sheet, wherein the cellulosic suspension is flocculated by the addition of a water soluble cationic synthetic polymer of intrinsic viscosity of at least 4 dl/g, wherein the flocculated cellulosic suspension is subjected to mechanical shearing and then reflocculated by a subsequent addition of a reflocculating system, and in which the reflocculating system comprises i) a siliceous material and ii) a water soluble anionic polymer of intrinsic viscosity at least 4 dl/g, and in which the siliceous material (i) and water soluble anionic polymer (ii) are added to the cellulosic suspension subsequent to the centriscreen and wherein the cationic polymer is added to a thin stock stream of the cellulosic suspension.

2. A process according to claim 1 in which the siliceous material is an anionic microparticulate material.

3. A process according to claim 1 in which the siliceous material comprises material selected from the group consisting of silica based particles, silica microgels, colloidal silica, silica sols, silica gels, polysilicates, cationic silica, aluminosilicates, polyaluminosilicates, borosilicates, polyborosilicates and zeolites.

4. A process according to claim 1 in which the siliceous material is a swellable clay.

5. A process according to claim 4 in which the swellable clay is a bentonite type clay.

6. A process according to claim 4 in which the swellable clay is selected from the group consisting of hectorite, smectites, montmorillonites, nontronites, saponite, sauconite, hormites, attapulgites and sepiolites.

7. A process according to claim 1 in which the water soluble cationic polymer exhibits a charge density below 5 meq/g.

8. A process according to claim 1 in which the water soluble cationic polymer is formed from water soluble ethylenically unsaturated monomer or water soluble blend of ethylenically unsaturated monomers comprising at least one cationic monomer.

9. A process according to claim 1 in which the water soluble cationic polymer comprises up to 50% by weight cationic monomer units.

10. A process according to claim 1 in which the water cationic soluble polymer is a branched water soluble polymer which exhibits a rheological oscillation value of tan delta at 0.005 Hz of above 0.7 (calculated on a 1.5% by weight aqueous solution of the polymer).

11. A process according to claim 1 in which the water soluble cationic polymer has an intrinsic viscosity of at least 7 dl/g.

12. A process according to claim 1 in which the water soluble anionic polymer comprised in the reflocculating system is substantially linear.

13. A process according to claim 1 in which the water soluble anionic polymer has an intrinsic viscosity of at least 7 dl/g.

14. A process according to claim 1 in which the water soluble anionic polymer has been formed from a water soluble anionic monomer or blend of water soluble monomers comprising one or more water soluble anionic monomers.

15. A process according to claim 1 in which the cellulosic suspension comprises filler.

16. A process according to claim 1 in which the sheet of paper or paper board comprises up to 40% by weight filler.

17. A process according to claim 16 in which the filler material is selected from the group consisting of precipitated calcium carbonate, ground calcium carbonate, clays (especially kaolin) and titanium dioxide.

18. A process according to claim 1 in which the cellulosic suspension is substantially free of filler.

* * * * *